US006012402A

United States Patent [19]

Sekine

[11] Patent Number: 6,012,402

[45] Date of Patent: Jan. 11, 2000

[54] EMBROIDERY DATA DISPLAY UNIT AND EMBROIDERY SEWING MACHINE

[75] Inventor: Kiyokazu Sekine, Kuwana-gun, Japan

[73] Assignee: Brother Kogyo Kabushiki Kaisha, Nagoya, Japan

[21] Appl. No.: 08/966,648

[22] Filed: Nov. 10, 1997

[30] Foreign Application Priority Data

Nov. 13, 1996 [JP] Japan ..... 8-301929

[51] Int. Cl.[7] ..... D05B 21/00; D05C 5/02

[52] U.S. Cl. ..... 112/102.5; 112/155; 112/163; 112/470.04

[58] Field of Search ..... 112/102.5, 470.06, 112/155, 163, 167, 164, 165, 166, 470.04, 475.19; 364/470.09, 470.07

[56] References Cited

U.S. PATENT DOCUMENTS 4,869,188 9/1989 Hyodo ..... 112/445

5,904,109 5/1999 Asano ..... 112/102.5

*Primary Examiner*—Peter Nerbun

*Attorney, Agent, or Firm*—Oliff & Berridge, PLC

[57] ABSTRACT

Provided is an embroidery sewing machine for forming an embroidery pattern in accordance with embroidery data. The embroidery data includes position data indicative of a portion of a working fabric on which the embroidery pattern is to be formed, and color change data indicative of change of needle bars of the sewing machine. The sewing machine is provided with a thread color assigning system which assigns a thread collor to each of the needle bars, an order assigning system which assigns order of the needle bars to be used, a display device which displays the embroidery pattern based on the embroidery data and the order of the needle bars to be used change by the order changing system, and a sewing system which forms the embroidery pattern based on the embroidery data and the order of the needle bars to be used changed by the order changing system.

25 Claims, 11 Drawing Sheets

| | RED COMPONENT | GREEN COMPONENT | BLUE COMPONENT |
|---|---|---|---|
| NEEDLE BAR 1 | 0 | 0 | 0 |
| NEEDLE BAR 2 | 0 | 0 | 255 |
| NEEDLE BAR 3 | 255 | 0 | 0 |
| NEEDLE BAR 4 | 255 | 0 | 255 |
| NEEDLE BAR 5 | 0 | 255 | 0 |
| NEEDLE BAR 6 | 0 | 255 | 255 |
| NEEDLE BAR 7 | 255 | 255 | 0 |
| NEEDLE BAR 8 | 255 | 255 | 255 |
| NEEDLE BAR 9 | 127 | 127 | 127 |

FIG. 6A

| | RED COMPONENT | GREEN COMPONENT | BLUE COMPONENT |
|---|---|---|---|
| NEEDLE BAR 1 | 0 | 0 | 0 |
| NEEDLE BAR 2 | 0 | 0 | 255 |
| NEEDLE BAR 3 | 255 | 0 | 0 |
| NEEDLE BAR 4 | 255 | 0 | 255 |
| NEEDLE BAR 5 | 0 | 255 | 0 |
| NEEDLE BAR 6 | 0 | 255 | 255 |
| NEEDLE BAR 7 | 255 | 255 | 0 |
| NEEDLE BAR 8 | 255 | 255 | 255 |
| NEEDLE BAR 9 | 127 | 127 | 127 |

FIG. 6B

| SEWING ORDER | NEEDLE BAR NUMBER |
|---|---|
| 1 | 1 |
| 2 | 2 |
| 3 | 3 |
| 4 | 4 |
| 5 | 5 |
| 6 | 6 |
| 7 | 7 |
| 8 | 8 |
| 9 | 9 |

FIG. 10
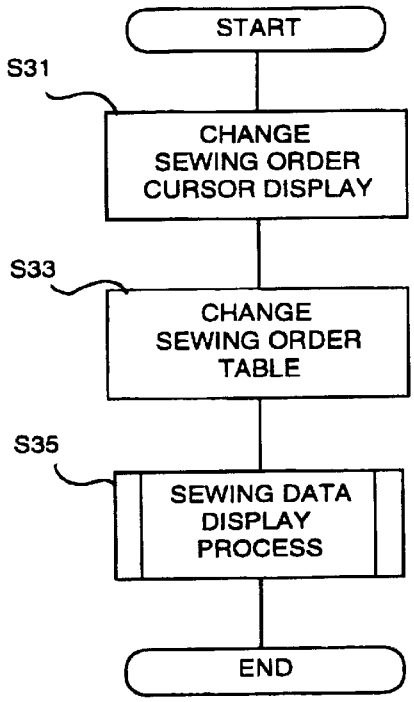
FIG. 11
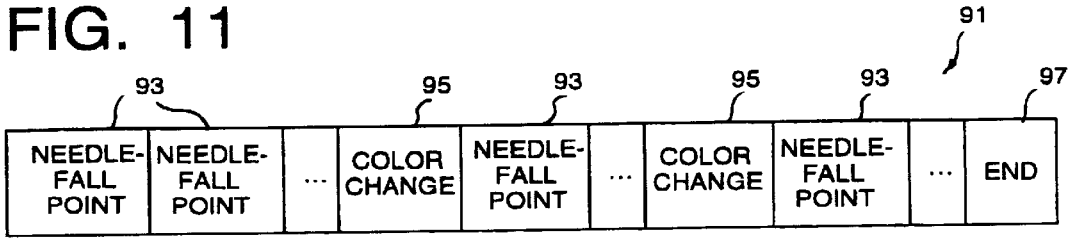
FIG. 12
PRIOR ART
| | |
|---|---|
| SEWING ORDER | 123 |
| NEEDLE BAR NO. | 159 |

EMBROIDERY DATA DISPLAY UNIT AND EMBROIDERY SEWING MACHINE

BACKGROUND OF THE INVENTION

The present invention relates to an embroidery data display unit for displaying an embroidery pattern corresponding to embroidery data and an embroidery sewing machine provided with the embroidery data display unit.

Embroidery data is constituted as described below when the data is one-needle data. Sewing data 91 serving as the embroidery data illustrated in FIG. 11 is constituted by arranging a plurality of needle-fall-point data 93 storing the coordinates of needle fall points (needle fall positions) on a working fabric and provided with color change codes 95 for indicating change of needle bars at places. Moreover, an end code 97 showing the end of data is added to the end of the sewing data 91. An embroidery sewing machine, on receiving the above sewing data 91, moves a working fabric to bring a point on the working fabric, which is designated by the needle-fall-point data 93, under a needle bar to successively form a stitch. Moreover, when a color change code 95 is detected, the sewing machine exchanges needle bars for forming a stitch in accordance with a predetermined order to change thread colors.

Conventionally, the embroidery data is saved in a floppy disk or the like so that the data can be easily transferred to the sewing machine. In such a case, conventionally, a sheet of paper showing an embroidery pattern corresponding to the embroidery data saved in the floppy disk and a sheet of paper showing a thread-color change order for sewing the embroidery pattern are attached to the floppy disk. Further, an indication as shown in FIG. 12 is displayed on a display unit of an embroidery sewing machine body when the embroidery data is used. That is, the displayed indication shows only the needle bar change order in the embroidery sewing machine.

Moreover, the relation between each needle bar and the color of a thread to be sewed by the needle bar can be changed in each embroidery sewing machine. Therefore, in the case of a conventional embroidery sewing machine, it is necessary to confirm that a thread color for each needle bar corresponds to the settings used in the embroidery data, and set a needle bar change order so that the thread color is changed in accordance with the order indicated in the sheet of paper associated with the embroidery data. As above, setting of a needle bar change sequence is a complex operation requiring skill. Moreover, because a conventional embroidery sewing machine has only the indication as shown in FIG. 12, when a thread with a color that is different from a thread color shown in the above sheet of paper is used, it is impossible to know, in advance, the color arrangement of an embroidery pattern which would be formed with the threads having different colors.

SUMMARY OF THE INVENTION

It is therefore an object of the invention to provide an improved embroidery data display unit and an embroidery sewing machine capable of displaying a sewed embroidery pattern in advance and enabling a needle bar change sequence to be set easily.

For the object, according to the present invention, there is provided an embroidery data display unit for displaying an embroidery pattern in accordance with embroidery data which includes position data indicating a portion of a working fabric on which the embroidery pattern is to be formed and color change data indicating change of needle bars of a sewing machine, the display unit comprising: an order assigning system which assigns order of the needle bars to be used, each needle bar corresponding to a predetermined color, the needle bars being changed in response to the color change data; and a display device which displays the embroidery pattern which would be formed on the working fabric if the embroidery pattern is sewed with the order of the needle bars assigned by order assigning system in accordance with the embroidery data.

Since the order of the needle bars can be changed, the color to be used when the color change code is detected is changed. The display device displays a color image of the embroidery pattern which corresponds to the current setting of the order of the needle bars. Therefore, when the color arrangement of the embroidery pattern which would be formed on the working fabric coincides with the color image thereof displayed on the display device.

Optionally, the order assigning system displays a plurality of cursors corresponding to the plurality of needle bars, the order of the needle bars being indicated by a displayed arrangement of the plurality of cursors on the display device, the order of the needle bars being changeable by changing arrangement of the plurality of cursors on the display device.

Further optionally, the position data indicates a plurality of stitch positions, and wherein the display device displays the embroidery pattern by connecting the stitch positions with lines, the lines having colors corresponding to the needle bars to be used for stitch positions defining the lines.

According to another aspect of the invention, there is provided an embroidery data display unit for displaying an embroidery pattern in accordance with embroidery data which includes position data indicating a portion of a working fabric on which the embroidery pattern is to be formed and color change data indicating change of needle bars of a sewing machine, a color of thread being changed in response to the color change data, the display unit comprising: thread color assigning system for assigning a thread color to each of the needle bars; and a display device which displays the embroidery pattern which would be formed on the working fabric if the embroidery pattern is sewed with the thread color assigned to each of the needle bars in accordance with the embroidery data.

Accordingly, by assigning a color to each needle bar, a desired color arrangement of the embroidery pattern can be achieved.

Optionally, the thread color assigning system displays a plurality of cursors indicating thread colors assigned to the plurality of needle bars on the display device, respectively, the thread color indicated by each of the plurality of cursors being changeable, the thread colors indicated by the plurality of needle bars being assigned to the plurality of needle bars, respectively.

Further optionally, the embroidery data display unit may be provided with a thread color displaying system which displays a plurality of colors that can be assigned to each of the needle bars; and a designation system which is manually operated to designate one of the plurality of colors; wherein the thread color assigning system assigns a color designated by the designation system as the thread color of a needle bar.

In particular, the thread color displaying system could display a color image of the plurality of colors.

Optionally, the thread color displaying system may display a color pallet on the display device.

According to furthermore aspect of the invention, there is provided an embroidery data display unit for displaying an embroidery pattern in accordance with embroidery data which includes position data indicating a portion of a working fabric on which the embroidery pattern is to be formed and color change data indicating change of needle bars of a sewing machine, the display unit comprising: a thread color assigning system which assigns a thread color to each of the needle bars; and an order assigning system which assigns order of the needle bars to be used, the needle bars being changed in response to the color change data; and a display device which displays the embroidery pattern based on the embroidery data and the order of the needle bars to be used changed by the order changing system.

Optionally, the thread color assigning system displays a plurality of cursors indicating thread colors assigned to the plurality of needle bars on the display device, respectively, the thread color indicated by each of the plurality of cursors being changeable, the thread colors indicated by the plurality of needle bars being assigned to the plurality of needle bars, respectively.

According to still further aspect of the invention, there is provided an embroidery sewing machine for forming an embroidery pattern in accordance with embroidery data which includes position data indicating a portion of a working fabric on which the embroidery pattern is to be formed and color change data indicating change of needle bars of the sewing machine, the display unit comprising a thread color assigning system which assigns a thread color to each of the needle bars, an order assigning system which assigns order of the needle bars to be used, the needle bars being changed in response to the color change data, a display device which displays the embroidery pattern based on the embroidery data and the order of the needle bars to be used changed by the order changing system, and a sewing system which forms the embroidery pattern based on the embroidery data and the order of the needle bars to be used changed by the order assigning system.

Optionally, the position data indicates a plurality of stitch positions, and the display device displays the embroidery pattern by connecting the stitch positions with lines, the lines having colors corresponding to the needle bars to be used for stitch positions defining the lines.

Further, the embroidery sewing machine may include a thread color displaying system which displays a plurality of colors that can be assigned to each of the needle bars; and a designation system which is manually operated to designate one of the plurality of colors; wherein the thread color assigning system assigns a color designated by the designation system as the thread color of a needle bar.

Optionally, the thread color assigning system displays a plurality of cursors indicating thread colors assigned to the plurality of needle bars on the display device, respectively, the thread color indicated by each of the plurality of cursors being changeable, the thread colors indicated by the plurality of needle bars being assigned to the plurality of needle bars, respectively.

Alternatively or optionally, the order assigning system displays a plurality of cursors corresponding to the plurality of needle bars, the order of the needle bars being indicated by a displayed arrangement of the plurality of cursors on the display device, the order of the needle bars being changeable by changing arrangement of the plurality of cursors on the display device.

Further optionally, the thread color displaying system displays a color image of the plurality of colors.

In particular, the thread color displaying system displays a color pallet on the display device.

Still optionally, the embroidery sewing machine may be provided with a needle bar change system which changes the needle bars in accordance with the order assigned by the order assigning system in response to the color data; and a fabric driving system which drives the working fabric with respect to the needle bars in accordance with the position data.

Yet further aspect of the invention, there is provided an embroidery sewing machine for forming an embroidery pattern in accordance with embroidery data which includes position data indicating a portion of a working fabric on which the embroidery pattern is to be formed and color change data indicating change of a plurality of needle bars of the sewing machine, the sewing machine includes: a displaying device; a setting displaying system which displays a plurality of cursors, the plurality of cursors respectively indicating colors and order of the plurality of needle bars; a setting changing system which is manually operable to change at least one of the color or order of the plurality of cursors; and a pattern display system which displays the embroidery pattern which would be formed on the fabric if the embroidery pattern is sewed with the setting indicated by the plurality of cursors, on the display device.

Optionally, the embroidery sewing machine may include: a setting assigning system which assigns the order indicated by the plurality of cursors to the plurality of needle bars; and a sewing system which forms the embroidery pattern based on the embroidery data and the order of the needle bars assigned to the plurality of needle bars.

Accordingly, only by changing the displayed status, the embroidery which would be formed can be recognized in advance, and setting can be changed without further operation.

DESCRIPTION OF THE ACCOMPANYING DRAWINGS

FIGS. 6A and 6B are tables illustrating color setting for each needle bar and sewing order, respectively;

FIG. 10 is a flowchart illustrating a sewing sequence change process;

FIG. 11 shows a schematic structure of sewing data;

FIG. 12 is a data displayed on a display unit provided on a conventional embroidery sewing machine.

DESCRIPTION OF THE EMBODIMENTS

Figure 1:
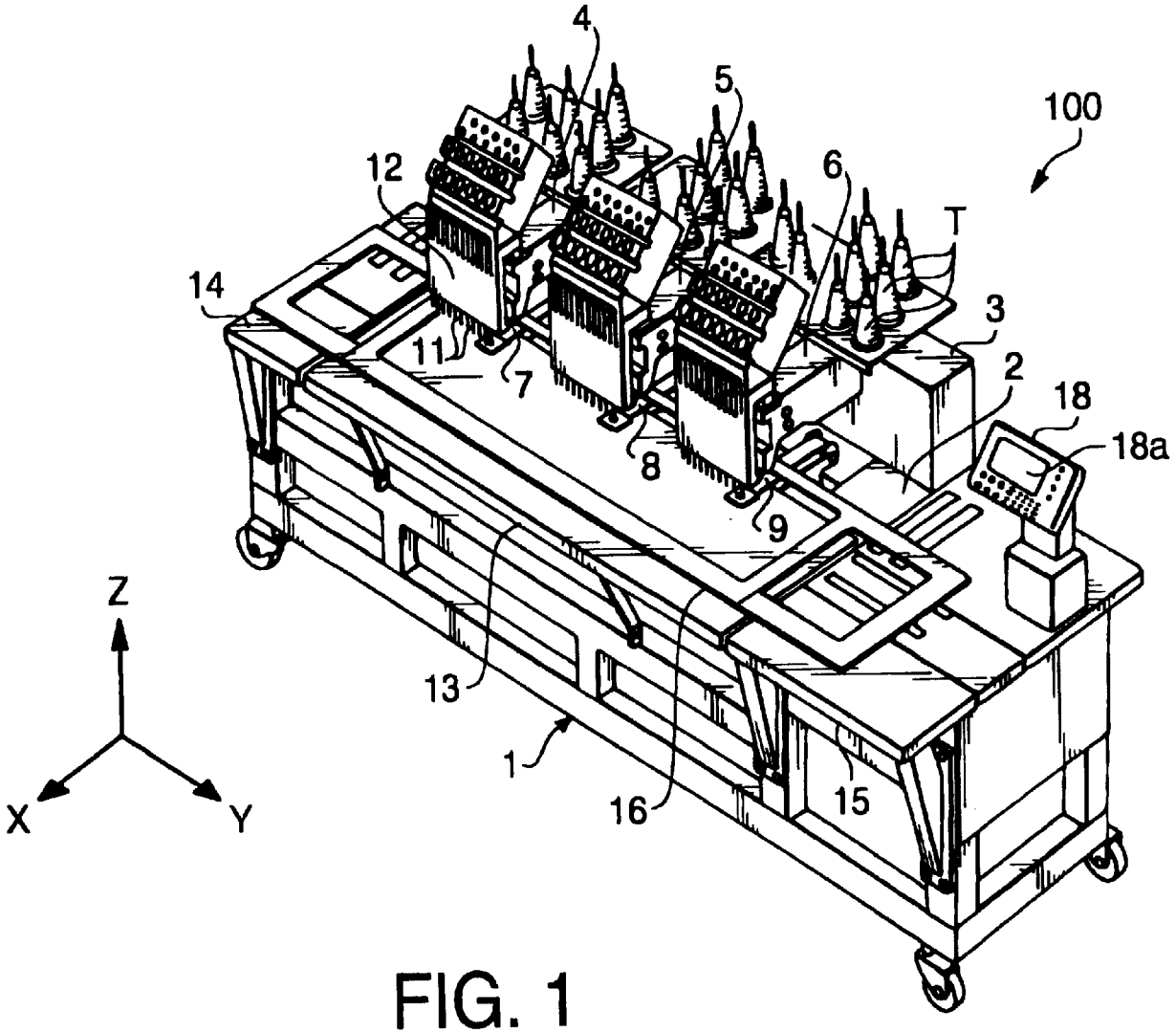
FIG. 1 is a perspective view showing a structure of an embroidery sewing machine according to an embodiment of the invention.

FIG. 1 is a perspective view showing a structure of an embroidery sewing machine 100 according to an embodiment of the invention. The embroidery sewing machine 100 is a three-head embroidery sewing machine, and further description will be made below.

As shown in FIG. 1, the embroidery sewing machine 100 has a base frame 1 extending in an X-direction (indicated by arrow in FIG. 1) and a machine support plate 2 is provided at the rear portion on an upper surface of the machine. On a rear end portion of the machine support plate 2, a support frame 3 extending in the X-direction is vertically mounted, and three heads 4, 5 and 6 are mounted on the support frame 3 at predetermined intervals. On an upper surface of the base frame 1, bed units 7, 8, and 9 are provided such that the bed units 7, 8 and 9 face the heads 4, 5 and 6, respectively.

A case 12 is provided on a front side portion of each of the heads 4, S and 6. The case 12 is movable in the X-direction with respect to the heads 4, 5 and 6. The case 12 supports nine sewing needles 11 which are arranged in a line extending in the X-direction, each sewing needle being movable in a Z-direction. A not-shown needle bar is provided above each sewing needle 11. A driving force of a spindle which will be described later is transmitted to the needle bar. By moving the case 12 in the X-direction, a needle bar to which the driving force is transmitted is changed. Thus, by moving the case 12, a sewing needle 11 which vertically moves is selected, and accordingly it is possible to change the colors of a thread T for forming a stitch.

Moreover, a working table 13 is provided in front of the machine support plate 2 such that an upper surface of the table 13 and an upper surface of the bed units 7 through 9 an on the substantially same plane. Auxiliary tables 14 and 15 are provided at both sides of the working table 13, and a rectangular workpiece holding frame 16 is provided above the working table 13 and the auxiliary tables 14 and 15. The workpiece holding frame 16 is constituted so as to hold a not-shown working fabric. The workpiece holding frame 16 is movable in X-direction (right and left direction in the drawing) and Y-direction (front and rear direction in the drawing). Furthermore, an operation panel 18 to be manually operated to execute various commands is provided together with a display 18*a* for displaying messages related to sewing on a rear portion of the auxiliary table 15.

Figure 2:
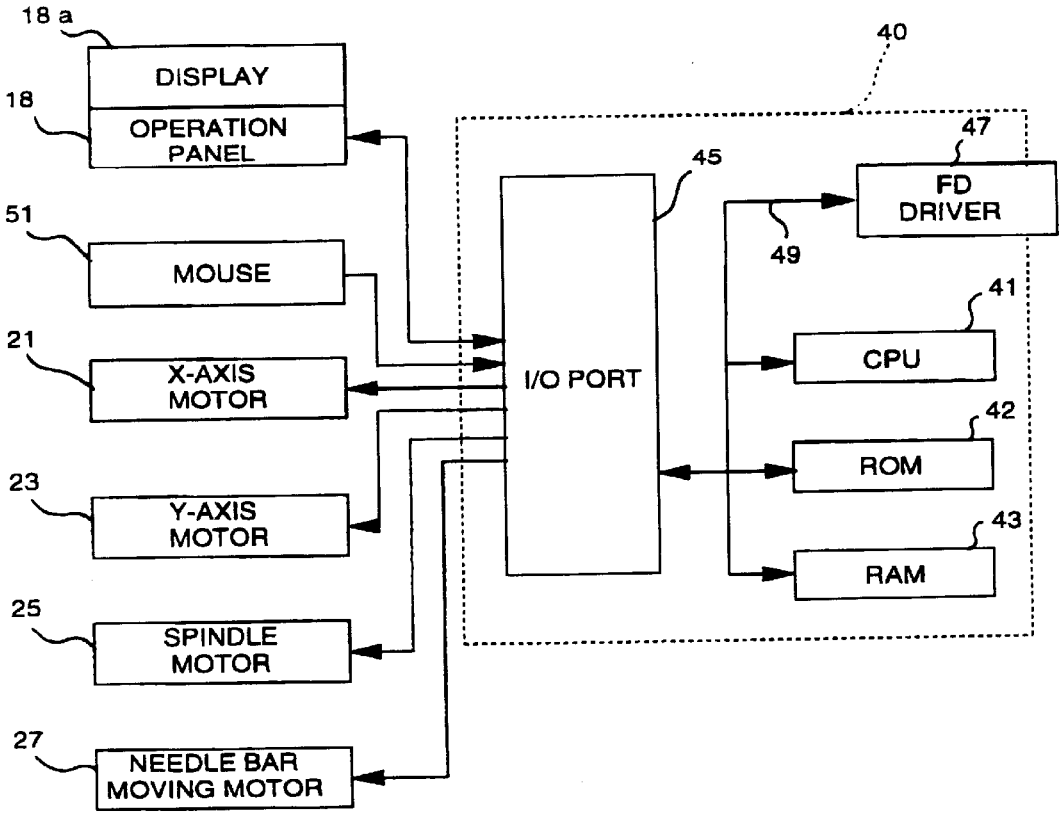
FIG. 2 is a block diagram of a control system of the embroidery sewing machine in FIG. 1.

The base frame 1, as shown in FIG. 2, accommodates an X-axis motor 21 and a Y-axis motor 23 for moving the workpiece holding frame 16 in X-direction and/or Y-direction, a spindle motor 25 for driving a not-shown common spindle passing through the heads 4 through 6, and a needle bar moving motor 27 for simultaneously moving the cases 12 of the heads 4 through 6 in the X-direction and exchanging needle bars to which the driving force of the spindle is transmitted. The motors 21, 23, 25 and 27, and the operation panel 18 are connected to an electronic control circuit 40 built in the base frame 1.

The electronic control circuit 40 includes a CPU (Central Processing Unit) 41, a ROM (Read only Memory) 42, and RAM (Random Access Memory) 43. Further, the electronic control circuit 40 is provided with an input/output (I/O) port 45 for transmitting data to and from the motors 21, 23, 25 and 27 and operation panel 18, and a floppy disk driver (FDD) 47 for reading or writing data in or from a floppy disk (not shown) which serves as a storage medium. The CPU 41, ROM 42, RAM 43, I/O port 45, and FDD 47 are connected to each other through a bus 49 so as to be able to transfer data therebetween. A well-known driving circuit (not shown) is provided in a data transmitting/receiving section of the I/O port 45 for transmitting data to and from the motors 21, 23, 25 and 27. It is possible to connect a mouse 51 to the I/O port 45 through a not-shown connector. Alternatively, it is possible to constitute the I/O port 45 such that a stylus pen or the like can be connected instead of the mouse 51.

Hereinafter, various processes executed by the electronic control circuit 40 are described below.

Figure 3:
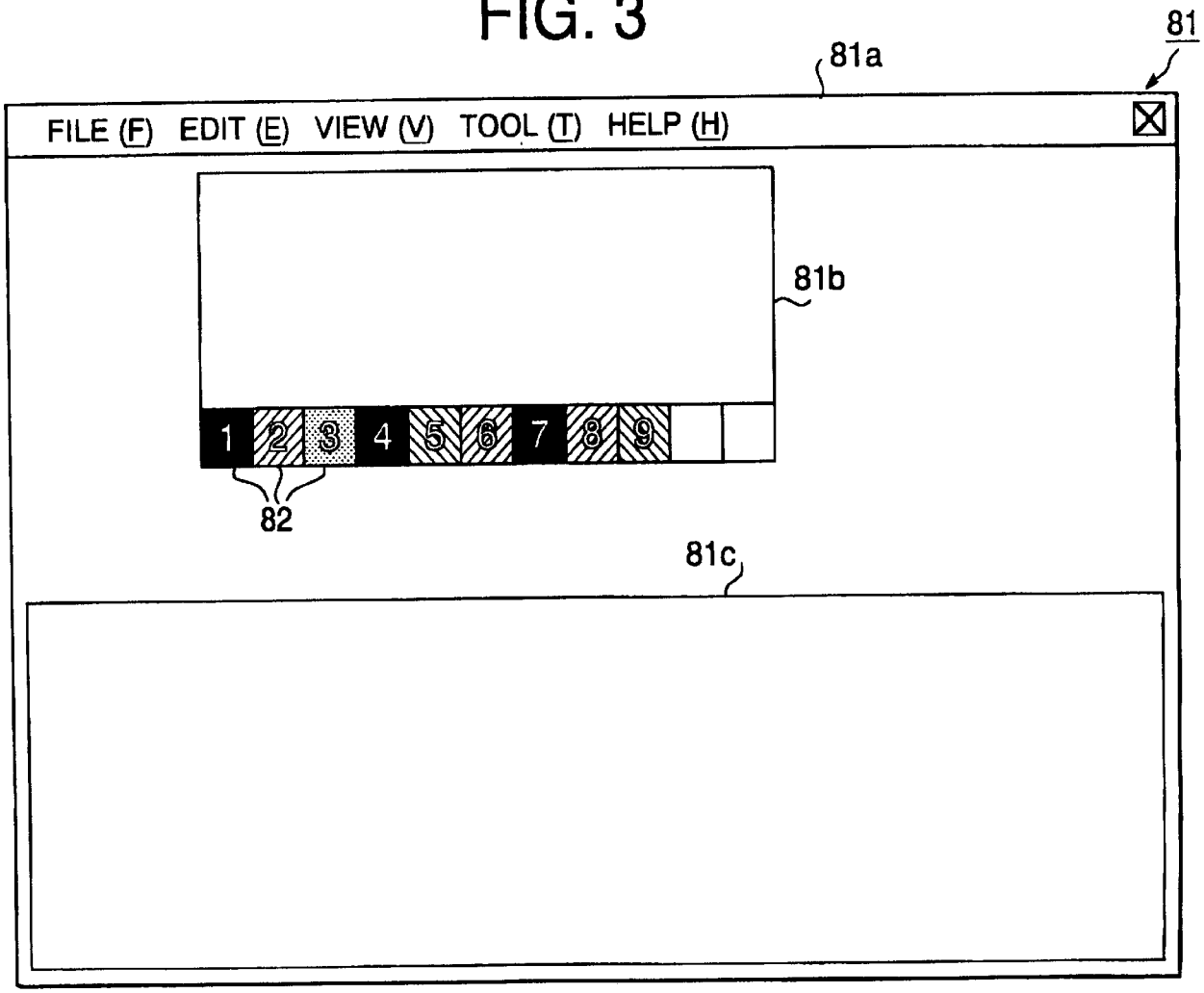
FIG. 3 shows an initial screen image when a sewing order is changed.

When a power is supplied to the electronic control circuit 40, the electronic control circuit 40 displays a basic screen image 81 shown in FIG. 3 on the display 18*a*. On the basic screen image 81, a small frame 81*b* and a large frame 81*c* are displayed as arranged vertically (up-down direction in FIG. 3) inside an external frame 81*a*. Moreover, thread color display boxes 82 for color-displaying thread colors corresponding to respective needle bars (hereafter, needle bar numbers are indicated by numbers <1> to <9>) are displayed at the lower side portion of the frame 81*b*. Immediately after the power is supplied, thread colors set as initial data are displayed on the thread color display boxes 82.

Figure 4:
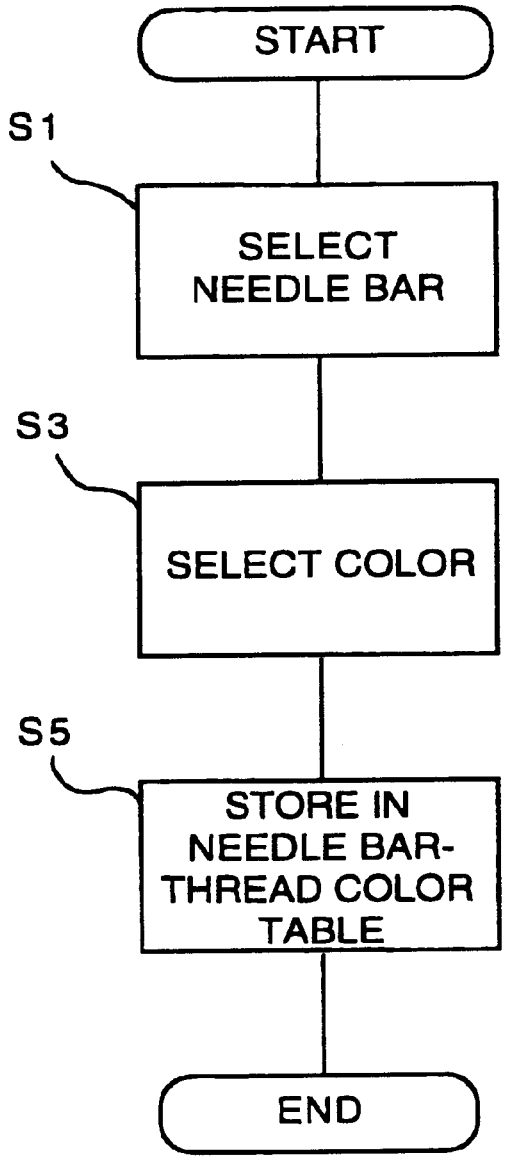
FIG. 4 is a flowchart showing a thread color setting process.

By locating a cursor (not shown) of the mouse (i.e., a mouse pointer) onto one of the thread color display boxes 82 and clicking a mouse button of the mouse 51, the electronic control circuit 40 executes the shown sequence in FIG. 4 in accordance with a program stored in the ROM 42.

As shown in FIG. 4, when the thread color setting process is started, the electronic control circuit 40 first reads a needle bar number selected by the mouse 51 in S1 (S denotes a step hereinafter). Then, in S3, the electronic control circuit 40 displays a color pallet screen 83 shown in FIG. 5 by superimposing the color pallet screen 83 on the basic screen 81. Then, the electronic control circuit 40 reads a thread color selected by the mouse 51 as described below.

Figure 5:
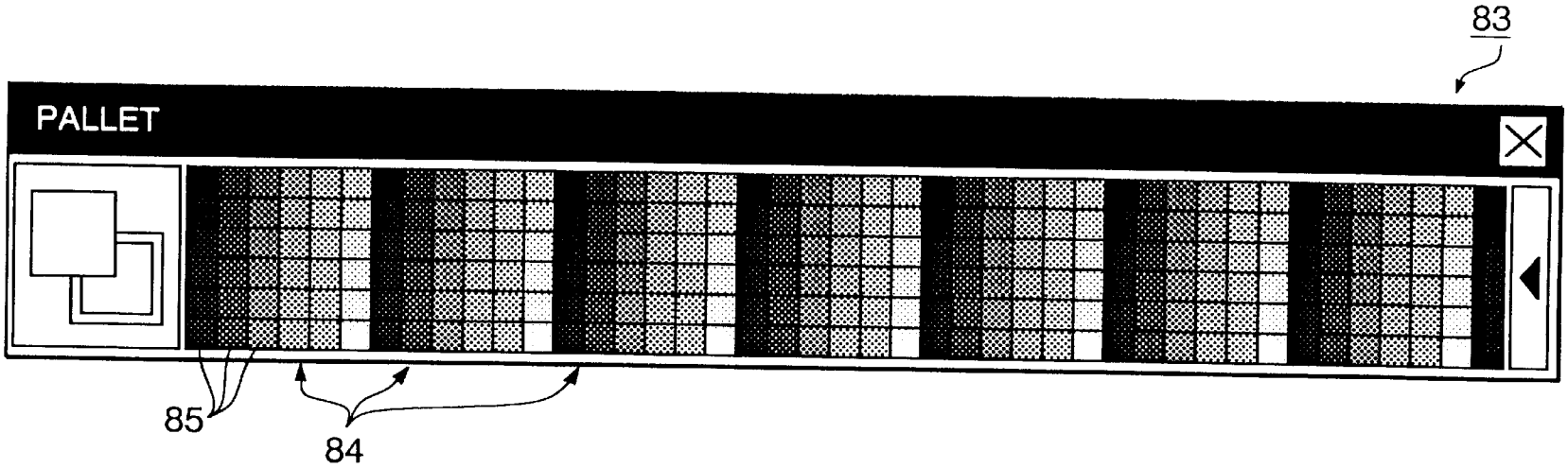
FIG. 5 is a screen image of a color pallet used for setting a thread color.

As shown in FIG. 5, the color pallet screen 83 is divided into a plurality of basic color display portions 84 for displaying various basic colors in colors and each basic color display portion 84 is divided into a plurality of blocks 85 in which chroma saturation and lightness are gradually differentiated from each other. Note that, each block 85 corresponds to each needle bar. An operator determines a color same as the color of the thread actually corresponding to a needle bar selected in S1, from among the colors displayed in the blocks 85, moves the mouse cursor onto the desired block 85, and clicks the button of the mouse 51. Then, the color is selected in S3. When the color is selected, the color pallet 83 disappears and the screen on the display 18*a* returns to the state shown in FIG. 3. It should be noted that, at this stage, the thread color display portion 82 corresponding to the needle bar number selected in S1 changes to the color selected in S3.

In S5 in FIG. 4, the relationship between the needle bar and the thread color selected in S1 and S3 is stored in a needle-bar thread-color table provided in the RAM 43 and the process shown in FIG. 4 is completed. FIG. 6A shows an example of the needle-bar thread-color table which stores the relationship between needle bars <1> through <9> and the intensities of red component, green component, and blue component indicated by numerical values of 0 to 255. In the example shown in FIG. 6A, the needle bar <8> in which every component has a value of 255 corresponds to white, and the needle bar <9> in which every component has a middle value of 127 corresponds to gray. It is possible to execute the thread color setting processing for each of the needle bars <1> to <9> by operating the mouse 51 according to necessity.

Figure 7:
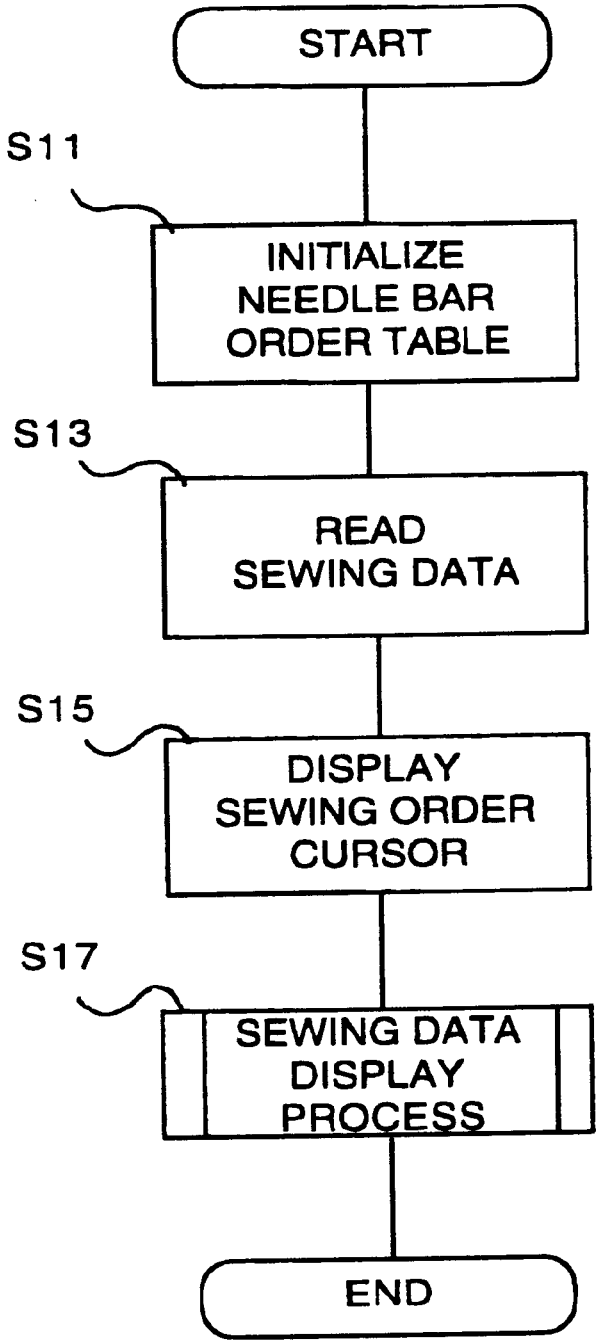
FIG. 7 is a flowchart showing a main process of the embroidery sewing machine.

After the needle-bar thread-color table is set as described above, when a floppy disk storing the sewing data 91 (FIG. 11) is inserted into the floppy disk driver 47, the electronic control circuit 40 executes the main process shown in FIG. 7 in accordance with a program stored in the ROM 42.

When the main process is started, the electronic control circuit 40 first initializes a sewing order table stored in the RAM 43 (S11). FIG. 6B shows the sewing order table which stores the order of the needle bars <1> to <9> to be used. In S11, the order of the needle bars <1> to <9> is input for the needle bars <1>, <2>, <3> . . . , in order.

Figure 8:
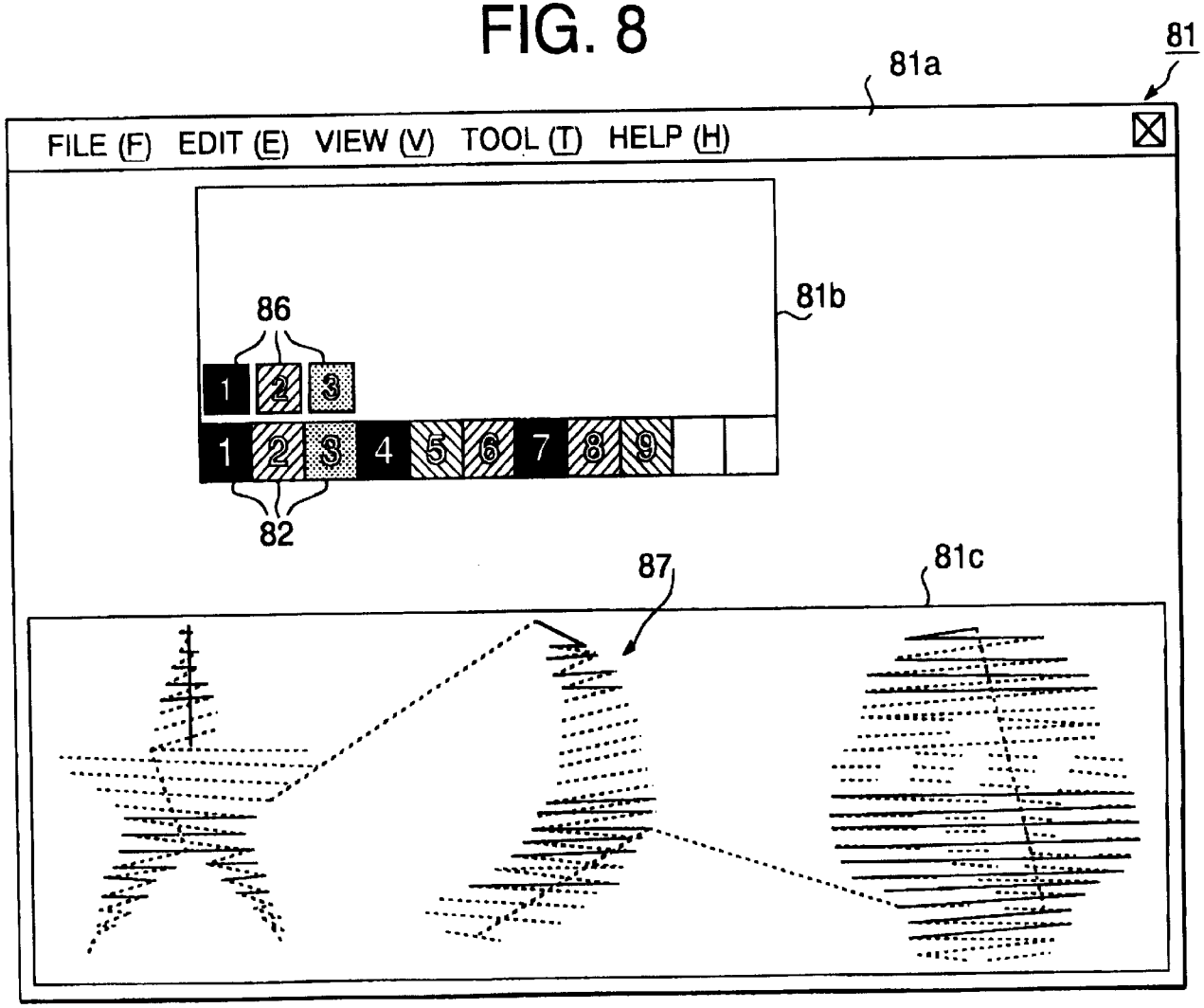
FIG. 8 is a screen image in which sewing order cursors, and embroidery patterns are displayed.

In S13, the entire sewing data 91 is read out of the floppy disk through the floppy disk driver 47. Then, in S15, the number of color change codes 95 included in the sewing data 91 read out in S13 is detected, and sewing order cursors 86 are displayed in accordance with the number of color change codes. For example, when two color change codes 95 are included in the sewing data 91, three needle bars can be used at the maximum. Therefore, as illustrated in FIG. 8, sewing order cursors 86 corresponding to high-order three needle bars in the sewing order table (in this case, needle bars <1>, <2>, and <3>) are displayed above the thread color display area 82 in the frame 81*b*. It should be noted that, as shown in FIG. 8, the sewing sequence cursors 86 are displayed with the thread colors currently assigned to the corresponding needle bars.

Then, the sewing data display process for displaying an embroidery pattern 87 (FIG. 8) corresponding to the sewing data 91 read out in S11 (S17) in the large frame 81*c* is executed, and the process is terminated.

The sewing data display process is described below.

Figure 9:
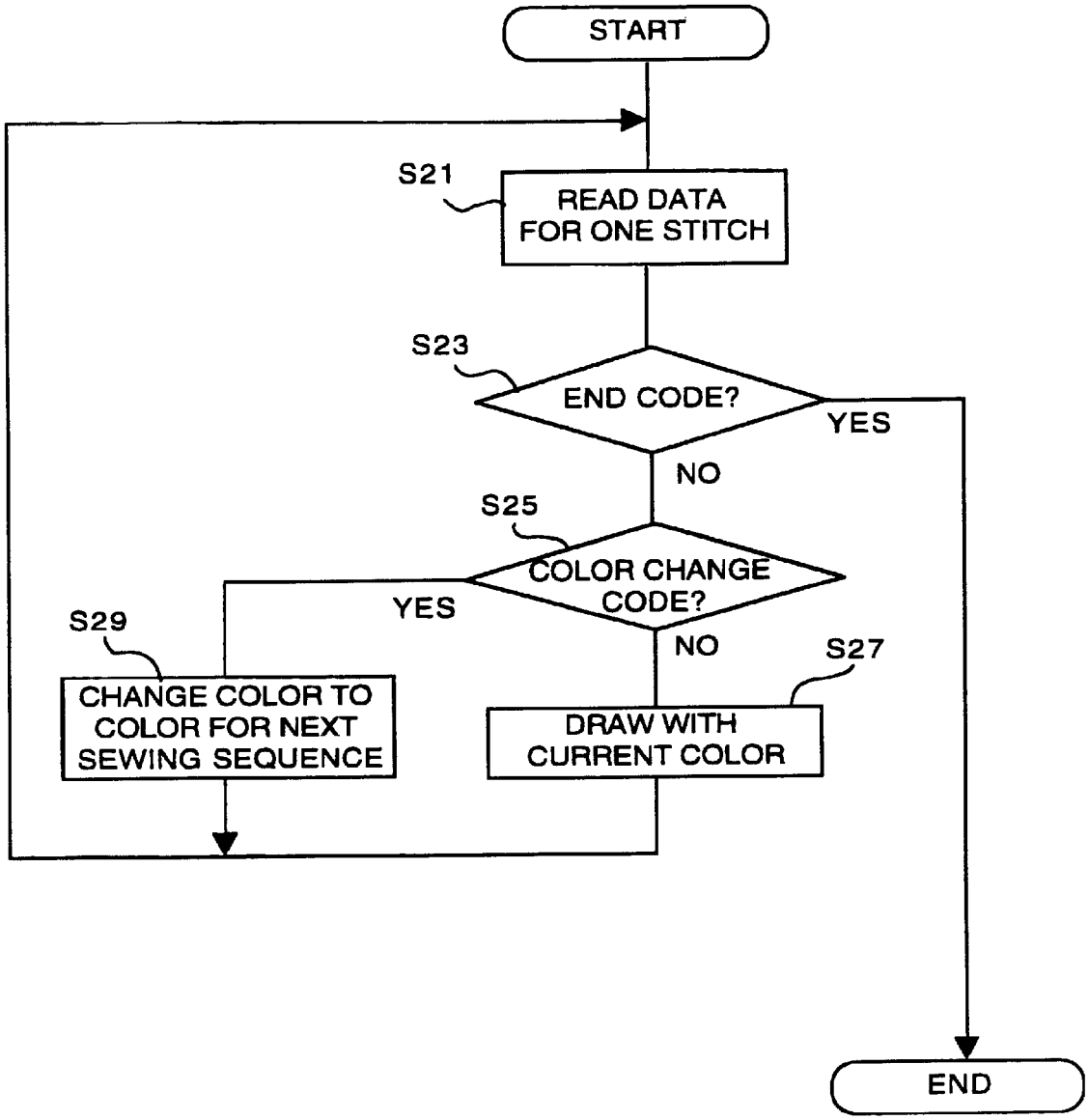
FIG. 9 is a flowchart illustrating a sewing data display process.

FIG. 9 shows a flowchart illustrating the sewing data display process. When the sewing data display process is started, data for one stitch is read out in S21. The data for one stitch is, for example, the needle-fall-point data 93, color change code 95, or end code 97 in the case of the sewing data 91 shown in FIG. 11. It is decided whether the read data is the end code 97 in S23, and whether the data is the color change code 95 in S25 in order. When negative decision is made in S23 and S25, i.e., if the read data does not represent the color change code (S23:NO) or the end code (S2S:NO), it is determined that the read data is the needle-fall-point data 93. In this case, S27 is executed and a line corresponding to the need-fall-point data 93 is drawn with the color presently assigned to the needle bar.

At the start of the sewing data display process, a thread color corresponding to a sewing order 1 (in the case of the above example, the thread color of the needle bar <1>) is used as the present color. In S27, a point designated by the coordinates of the needle-fall-point data 93 previously read out are connected with a point designated by the coordinates of the needle-fall-point data 93 currently read out in S21 with a line segment of the above present color, and control goes back to S21. It should be noted that, when the needle-fall-point data 93 is read out for the first time within a sewing sequence, a dot having the present color is displayed on a point designated by the coordinates.

If the data read out in S21 is the color change code 95, decision in S25 is YES, and S29 is executed. In this case, the present color is changed to a thread color corresponding to the color for the next sewing sequence and control goes back to S21. If the data read out in S21 is the completion code 97, decision in S23 and the process is completed. According to the above process, the embroidery pattern 87 corresponding to an actual color when sewing is performed in accordance with the sewing data 91 is displayed in the frame 81*c*.

Therefore, even when a thread having a new color is used, it is possible to easily confirm the embroidery pattern 87, which would be formed, on the display 18*a*.

Further, since the present embroidery sewing machine sets the thread colors for the needle bars <1> to <9> using the color pallet screen 83, a thread color can be visually selected and accordingly selection of the thread color can be performed appropriately and easily.

Furthermore, in the sewing data display process, the embroidery pattern 87 is displayed as a set of lines corresponding to the sewing data 91. Therefore, the displayed embroidery pattern 87 closely coincides with an embroidery pattern which would actually be embroidered.

Figure 13A:
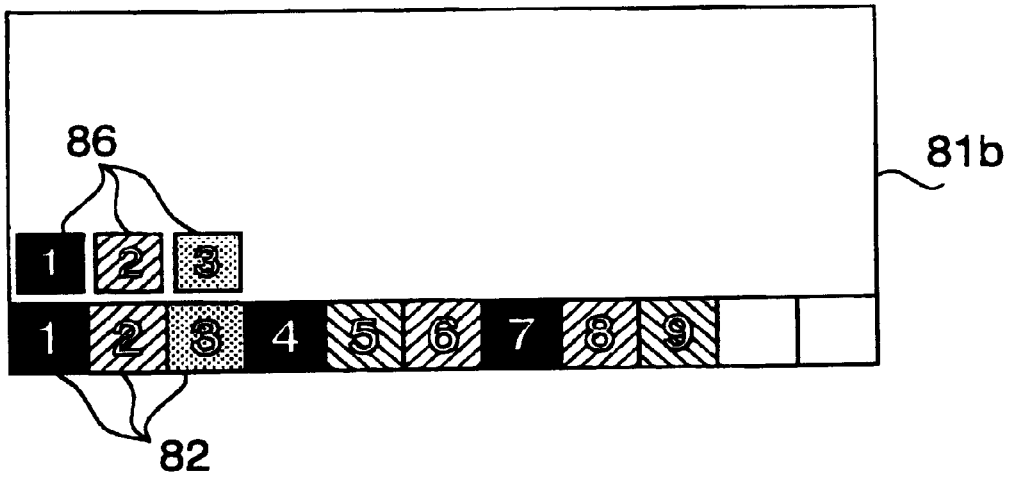
FIGS. 13A and 13B show the sewing sequence cursors, displayed condtion thereof being changed.
Figure 13B:
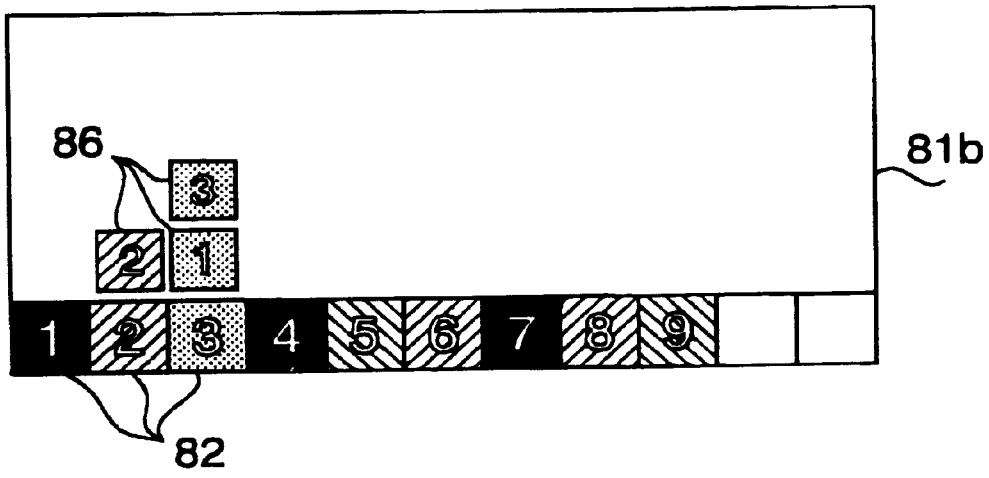

According to the embroidery sewing machine 100, it is possible to change the order of the sewing sequence cursors 86 with use of the mouse 51. In order to exchange the order of the sewing sequence cursors 86, one of the sewing sequence cursors 86 is to be designated by the mouse 51, and then dragging (move a mouse pointer with holding down a mouse button) the designated cursor 86 to a desired position. FIGS. 13A and 13B show an example of the sewing sequence cursors 86, before and after the position thereof are changed. In this example, according to a status indicated by FIG. 13A, the first, second and third needle bars are used in this order. According to the status shown in FIG. 13B, the third needle bar is used first, the second needle bar is used next, and then, the third needle bar is used again. Change of the sewing order will be described in detail below with reference to FIG. 10.

When one of the sewing sequence cursors 86 is designated (i.e., when the mouse cursor is located on one of the sewing sequence cursors 86 and the mouse button is clicked), the electronic control circuit 40 executes the sewing order change process in accordance with a program stored in the ROM 42.

When the sewing order change process is started, display status of the sewing sequence cursors 86 are first changed in accordance with the above operation (i.e., an operation of moving the position of the cursors 86) by the mouse 51 or the like in S31. Then, in S33, the needle bar numbers in the sewing order table as shown in FIG. 6B are changed in accordance with the change of the sewing sequence cursors 86. Then, the above sewing data display processing is executed in S35 and then the process is completed. Thus, the embroidery pattern 87 displayed in the frame 81*c* is updated to show the colors corresponding to the change of the sewing order.

Therefore, even if a non-desired embroidery pattern 87 is displayed due to incorrect sewing order setting, it is possible to find an appropriate sewing order from which a desired embroidery pattern 87 is obtained by changing the sewing order in accordance with the above sewing sequence change process. In other words, with the embroidery sewing device 100, it is possible to detect a defectiveness of a current sewing order setting in advance, and change the sewing order to an appropriate one, easily.

After the above processes are finished, if an instruction to start sewing is given through the operation panel 18, the electronic control circuit 40 drives the motors 21, 23, 25 and 27 to perform a sewing operation (not shown) in accordance with the setting in the sewing-order table in FIG. 6B. Since the sewing operation based on the sewing data is well known, description thereof will be omitted. When the sewing operation starts, the electronic control circuit 40 drives the workpiece holding frame 16 in accordance with the needle-fall-point data 93, forms a stitch with the sewing needle 11, and moves the case 12 in accordance with the color change code 95 to selectively drive one of the nine needles 11. Thus, the embroidery pattern 87 as displayed in the frame 81*c* is formed on the working fabric which is held by the workpiece holding frame 16.

It should be noted that present invention is not limited to the above embodiment, but various modifications could be available as long as they are not deviated from the gist of the present invention.

For example, in the embodiment, the electronic control circuit 40 built in the base frame 1 controls the processes. However, it is also possible to execute the processes shown in FIGS. 3 to 10 with use of a personal computer and a CRT (Cathode Ray Tube) provided separately from an embroidery sewing machine. When the personal computer is used, it is possible that an operator is to input data into the embroidery sewing machine in response to the personal computer examining the most appropriate setting. Alternatively or optionally, it may be possible that the settings may be transmitted to the embroidery sewing machine through a communication cable, or by means of radio waves through an interface provided in the embroidery sewing machine. In the latter case, similar to the embodiment, the embroidery sewing machine could be controlled by the personal computer, and a desired embroidery pattern can be formed easily.

Still further, although the thread colors are set using the color pallet screen 83 in the embodiment, it is also possible to set the thread colors by inputting names of colors or code numbers thereof, through a keyboard or the like. Furthermore, it is possible to set a thread color by detecting the color of the thread T with a color sensor, or reading a bar code or the like provided on a bobbin on which the thread is held with use of a bar code reader. In this case, the thread colors are set automatically, and therefore, the operation is further simplified.

According to the embroidery sewing machine described above, it is possible to change the order of needle bars to be used and set thread colors corresponding to respective needle bars easily. Furthermore, the embroidery pattern which would be formed in accordance with the present setting can be viewed in advance. Therefore, it is possible to know a diffectiveness of the present setting. Further, the change of the setting is reflected on the displayed embroidery pattern, the setting of the needle bar change order easily. Furthermore, the appropriate order of the needle bars to be used can be determined beforehand. Moreover, even when using a thread having a new color, it is possible to know the color arrangement of a embroidery pattern which would be sewed in advance.

Still further, it is possible to visually select and set the thread colors for respective needle bars since the color pallet screen is displayed and selection is made on the color pallet screen.

The present disclosure relates to subject matter contained in Japanese Patent Application No. HEI 08-301929, filed on Nov. 13, 1996, which is expressly incorporated herein by reference in its entirety.

What is claimed is:

1. An embroidery data display unit for displaying an embroidery pattern in accordance with embroidery data which includes position data indicating a portion of a working fabric on which said embroidery pattern is to be formed and color change data indicating change of needle bars of a sewing machine, said display unit comprising:

an order assigning system which assigns order of said needle bars to be used, each needle bar corresponding to a predetermined color, said needle bars being changed in response to said color change data; and a display device which displays said embroidery pattern which would be formed on said working fabric if said embroidery pattern is sewed with the order of said needle bars assigned by the order assigning system in accordance with said embroidery data.

2. The embroidery data display unit according to claim 1, wherein said order assigning system displays a plurality of cursors corresponding to said plurality of needle bars, said order of said needle bars being indicated by a displayed arrangement of said plurality of cursors on said display device, said order of said needle bars being changeable by changing arrangement of said plurality of cursors on said display device.

3. The embroidery data display unit according to claim 1, wherein said position data indicates a plurality of stitch positions, and wherein said display device displays said embroidery pattern by connecting said stitch positions with lines, said lines having colors corresponding to the needle bars to be used for stitch positions defining said lines.

4. An embroidery data display unit for displaying an embroidery pattern in accordance with embroidery data which includes position data indicating a portion of a working fabric on which said embroidery pattern is to be formed and color change data indicating change of needle bars of a sewing machine, a color of thread being changed in response to said color change data, said display unit comprising:

a thread color assigning system for assigning a thread color to each of said needle bars; and a display device which displays said embroidery pattern which would be formed on said working fabric if said embroidery pattern is sewed with said thread color assigned to each of said needle bars in accordance with said embroidery data.

5. The embroidery data display unit according to claim 4, wherein said thread color assigning system displays a plurality of cursors indicating thread colors assigned to said plurality of needle bars on said display device, respectively, said thread color indicated by each of said plurality of cursors being changeable, said thread colors indicated by said plurality of needle bars being assigned to said plurality of needle bars, respectively.

6. The embroidery data display unit according to claim 4, further comprising:

a thread color displaying system which displays a plurality of colors that can be assigned to each of said needle bars; and a designation system which is manually operated to designate one of said plurality of colors;

wherein said thread color assigning system assigns a color designated by said designation system as the thread color of a needle bar.

7. The embroidery data display unit according to claim 6, wherein said thread color displaying system displays a color image of said plurality of colors.

8. The embroidery data display unit according to claim 7, wherein said thread color displaying system displays a color pallet on said display device.

9. An embroidery data display unit for displaying an embroidery pattern in accordance with embroidery data which includes position data indicating a portion of a working fabric on which said embroidery pattern is to be formed and color change data indicating change of needle bars of a sewing machine, said display unit comprising:

a thread color assigning system which assigns a thread color to each of said needle bars; and an order assigning system which assigns order of said needle bars to be used, said needle bars being changed in response to said color change data; and a display device which displays said embroidery pattern based on said embroidery data and said order of said needle bars to be used changed by said order changing system.

10. The embroidery data display unit according to claim 9, wherein said thread color assigning system displays a plurality of cursors indicating thread colors assigned to said plurality of needle bars on said display device, respectively, said thread color indicated by each of said plurality of cursors being changeable, said thread colors indicated by said plurality of needle bars being assigned to said plurality of needle bars, respectively.

11. The embroidery data display unit according to claim 9, wherein said order assigning system displays a plurality of cursors corresponding to said plurality of needle bars, said order of said needle bars being indicated by a displayed arrangement of said plurality of cursors on said display device, said order of said needle bars being changeable by changing arrangement of said plurality of cursors on said display device.

12. The embroidery data display unit according to claim 9, wherein said position data indicates a plurality of stitch positions, and wherein said display device displays said embroidery pattern by connecting said stitch positions with lines, said lines having colors corresponding to the needle bars to be used for stitch positions defining said lines.

13. The embroidery data display unit according to claim 9, further comprising:

a thread color displaying system which displays a plurality of colors that can be assigned to each of said needle bars; and a designation system which is manually operated to designate one of said plurality of colors;

wherein said thread color assigning system assigns a color designated by said designation system as the thread color of a needle bar.

14. The embroidery data display unit according to claim 13, wherein said thread color displaying system displays a color image of said plurality of colors.

15. The embroidery data display unit according to claim 14, wherein said thread color displaying system displays a color pallet on said display device.

16. An embroidery sewing machine for forming an embroidery pattern in accordance with embroidery data which includes position data indicating a portion of a working fabric on which said embroidery pattern is to be formed and color change data indicating change of needle bars of said sewing machine, said sewing machine comprising:

a thread color assigning system which assigns a thread color to each of said needle bars;

an order assigning system which assigns order of said needle bars to be used, said needle bars being changed in response to said color change data;

a display device which displays said embroidery pattern based on said embroidery data and said order of said needle bars to be used changed by said order changing system; and a sewing system which forms said embroidery pattern based on said embroidery data and said order of said needle bars to be used that are assigned by said order assigning system.

17. The embroidery sewing machine according to claim 16, wherein said thread color assigning system displays a plurality of cursors indicating thread colors assigned to said plurality of needle bars on said display device, respectively, said thread color indicated by each of said plurality of cursors being changeable, said thread colors indicated by said plurality of needle bars being assigned to said plurality of needle bars, respectively.

18. The embroidery sewing machine according to claim 16, wherein said order assigning system displays a plurality of cursors corresponding to said plurality of needle bars, said order of said needle bars being indicated by a displayed arrangement of said plurality of cursors on said display device, said order of said needle bars being changeable by changing arrangement of said plurality of cursors on said display device.

19. The embroidery sewing machine according to claim 16, wherein said position data indicates a plurality of stitch positions, and wherein said display device displays said embroidery pattern by connecting said stitch positions with lines, said lines having colors corresponding to the needle bars to be used for stitch positions defining said lines.

20. The embroidery sewing machine according to claim 16, further comprising:

a thread color displaying system which displays a plurality of colors that can be assigned to each of said needle bars; and a designation system which is manually operated to designate one of said plurality of colors;

wherein said thread color assigning system assigns a color designated by said designation system as the thread color of a needle bar.

21. The embroidery sewing machine according to claim 20, wherein said thread color displaying system displays a color image of said plurality of colors.

22. The embroidery sewing machine according to claim 21, wherein said thread color displaying system displays a color pallet on said display device.

23. The embroidery sewing machine according to claim 16, further comprising:

a needle bar change system which changes said needle bars in accordance with said order assigned by said order assigning system in response to said color change data; and a fabric driving system which drives said working fabric with respect to said needle bars in accordance with said position data.

24. An embroidery sewing machine for forming an embroidery pattern in accordance with embroidery data which includes position data indicating a portion of a working fabric on which said embroidery pattern is to be formed and color change data indicating change of a plurality of needle bars of said sewing machine, said sewing machine comprising:

a displaying device;

a setting displaying system which displays a plurality of cursors, said plurality of cursors respectively indicating colors and order of said plurality of needle bars;

a setting changing system which is manually operable to change at least one of the color or order of said plurality of cursors; and a pattern display system which displays said embroidery pattern which would be formed on said fabric if said embroidery pattern is sewed with the setting indicated by said plurality of cursors, on said display device.

25. The embroidery sewing machine according to claim 24, further comprising:

a setting assigning system which assigns the order indicated by said plurality of cursors to said plurality of needle bars; and a sewing system which forms said embroidery pattern based on said embroidery data and said order of said needle bars assigned to said plurality of needle bars.

* * * * *